US005173213A

United States Patent [19]

Miller et al.

[11] Patent Number: 5,173,213

[45] Date of Patent: Dec. 22, 1992

[54] CORROSION AND ANTI-FOULANT COMPOSITION AND METHOD OF USE

[75] Inventors: Richard F. Miller, Humble; John Petersen, Robstown, both of Tex.

[73] Assignee: Baker Hughes Incorporated, Houston, Tex.

[21] Appl. No.: 790,196

[22] Filed: Nov. 8, 1991

[51] Int. Cl.[5] ..... C23F 11/14

[52] U.S. Cl. ..... 252/394; 252/392; 252/396; 252/403; 252/405; 252/407; 208/48 AA; 208/47; 423/226; 423/228; 423/229

[58] Field of Search ..... 252/392, 394, 396, 403, 252/405, 407; 423/226, 228, 229; 208/48 AA, 47

[56] References Cited

U.S. PATENT DOCUMENTS

| | | | |
|---|---|---|---|
| 3,282,970 | 11/1966 | Riggs | 252/396 |
| 4,440,625 | 4/1984 | Go et al. | 208/48 AA |
| 4,456,526 | 6/1984 | Miller et al. | 208/48 AA |
| 4,469,586 | 9/1984 | Ferm | 208/48 AA |
| 4,490,275 | 12/1984 | Niu | 252/392 X |
| 4,551,226 | 11/1985 | Ferm | 208/48 AA |
| 4,647,366 | 3/1987 | Edmondson | 564/479 X |
| 4,654,450 | 3/1987 | Miller | 208/48 AA X |
| 4,673,489 | 6/1987 | Roling | 208/48 AA |
| 4,890,720 | 6/1989 | Reid | 208/48 AA |

*Primary Examiner*—Robert L. Stoll
*Assistant Examiner*—Valerie Fee
*Attorney, Agent, or Firm*—Steve Rosenblatt

[57] ABSTRACT

The corrosion and fouling of metal surfaces in contact with corrosive acid fluids or acid salts in the presence of an aqueous medium is reduced by contacting the surfaces with a composition which comprises (a) an anti-fouling amount of a hydroxyl amine compound of the formula $R_1R_2N—OH$ wherein $R_1$ and $R_2$ are independently hydrogen or a hydrocarbyl or inertly substituted hydrocarbyl or both $R_1$ and $R_2$ are collectively a divalent hydrocarbyl combined with said nitrogen to form a heterocyclic ring, and (b) a corrosion-inhibiting amount of a reaction product of or a mixture for the purpose of a reaction product of a polyalkylene polyamine and an alkynediol. The polyalkylene polyamine is one that contains from 2–10 amine groups, each separated from another by an alkylene group having from 2–6 carbon atoms. The alkynediol has from 2 to 6 carbon atoms.

5 Claims, 1 Drawing Sheet

CORROSION AND ANTI-FOULANT COMPOSITION AND METHOD OF USE

FIELD OF THE INVENTION

This invention relates to compositions and methods for inhibiting or reducing corrosion and fouling of metal surfaces contacted with corrosive acids or salts and other compounds in the presence of an appreciable amount of water. More particularly, this invention relates to compositions and methods for reducing or inhibiting corrosion and fouling of alkanol amine gas scrubbing systems.

BACKGROUND OF THE INVENTION

In the refining of hydrocarbon feedstocks, the feedstocks are distilled into fractions, and various fractions and fraction mixes are often in turn subjected to cracking operations to produce methane, olefins and other gases. Contaminants in the crude hydrocarbons subjected to the refining operations include acids or acid-forming materials such as $CO_2$, $H_2S$, $CH_3SH$, HCl, and the like. The problems of corrosion of metal surfaces which come into contact with these acids or acid-forming materials are all too well known to the refining and processing arts.

These acid-forming materials must be removed from natural and cracked gas streams (which contain such hydrocarbons as methane, olefins such as ethylene, styrene, butadiene, cyclopentadienes, etc.). One method of removing the acid gases is separating them from the hydrocarbon gases by absorption in an alkanol amine regenerative aqueous absorbent system. Regenerative alkanol amine aqueous absorbent units, as more fully described below, include columns with trays or other packing which are used to contact the aqueous alkanol amine solution which the acid-forming gases, and also include heat exchange surfaces which are normally used to conserve energy and regenerate the absorbent. The acid gases create corrosion and fouling problems in these alkanolamine units. Especially where velocity is low, such as around trays and in heat exchangers or at other outlets, fouling of the passages by ferrous oxides and insoluble acid salts of ferrous metals, such as ferrous sulfides and carbonates, occurs. The reactions which give rise to ferrous metal particulates are reactions which also surface erode ferrous metal through corrosion. In addition, the amines groups of the alkanol amines react with the acidic gases to form heat-stable salts which also form fouling deposits on the equipment. The acid salts of amines, both soluble and insoluble, require treatment of the system with caustic in order to maintain the pH at a level which reduces the severity of acid-induced corrosion. The presence of fouling agents requires that the system be shut down periodically for internal cleaning. Shutdown of a unit means lost capacity and is in addition, itself, an expensive, time-consuming operation.

The addition of chemicals to the system to reduce fouling or corrosion is generally a more economical and desirable method of dealing with the fouling or corrosion problem than plant shutdowns, and consequently, many chemicals have been investigated for anti-foulant or corrosion-resistant activity.

A particular problem with acid gas-contaminated gas feeds which contain unsaturated hydrocarbons such as those mentioned above is the formation of polymer gums in the alkanol amine equipment. In U.S. Pat. No. 4,575,455, hydroxyl amines were disclosed for use as an anti-foulant to combat the buildup of polymeric material resulting from the thermal polymerization of unsaturated hydrocarbons processed in alkanol amine gas-scrubbing equipment. The hydroxyl amine compound functioned as an oxygen scavenger for trace amounts of oxygen in the system that were effective to accelerate the polymerization giving the foulant gums, and it was also mentioned that oxygen would promote the sloughing of iron sulfide off walls of the unit, increasing the amount of iron sulfide available to foul reboilers.

In U.S. Pat. No. 4,490,275, the occurrence of amine-salt deposits in equipment was addressed by the use of dimethylaminoethanol and dimethylisopropanolamine as an alkanol amine. In U.S. Pat. No. 4,647,366, a composition of a reaction product of an alkynediol and a polyalkylene polyamine was stated useful to inhibit corrosion from propionic acids in the essential absence of water but to be ineffective to protect ferrous metal surfaces from corrosion from inorganic gases, such as hydrochloric acid, or even from acetic acid.

SUMMARY OF THE INVENTION

We have found that the corrosion and fouling of metal surfaces in contact with corrosive acid fluids or acid salts in the presence of an appreciable amount of water is reduced by contacting the surfaces with a composition which comprises (a) an anti-fouling amount of a hydroxyl amine compound of the formula $$R_1R_2N—OH$$

wherein $R_1$ and $R_2$ are independently hydrogen or a hydrocarbyl or both $R_1$ and $R_2$ are collectively a divalent hydrocarbyl combined with said nitrogen to form a heterocyclic ring, and (b) a corrosion-inhibiting amount of a reaction product of or a mixture for the purpose of a reaction product of a polyalkylene polyamine and an alkynediol. The polyalkylene polyamine is one that contains from 2–10 amine groups, each separated from another by an alkylene group having from 2–6 carbon atoms. The alkynediol has from 2 to 6 carbon atoms.

BRIEF DESCRIPTION OF THE DRAWING

The drawing is a simplified flow diagram of an alkanol amine acid gas absorption process unit treated in accordance with this invention.

DETAILED DESCRIPTION OF THE PREFERRED EMBODIMENT

Figure 1:
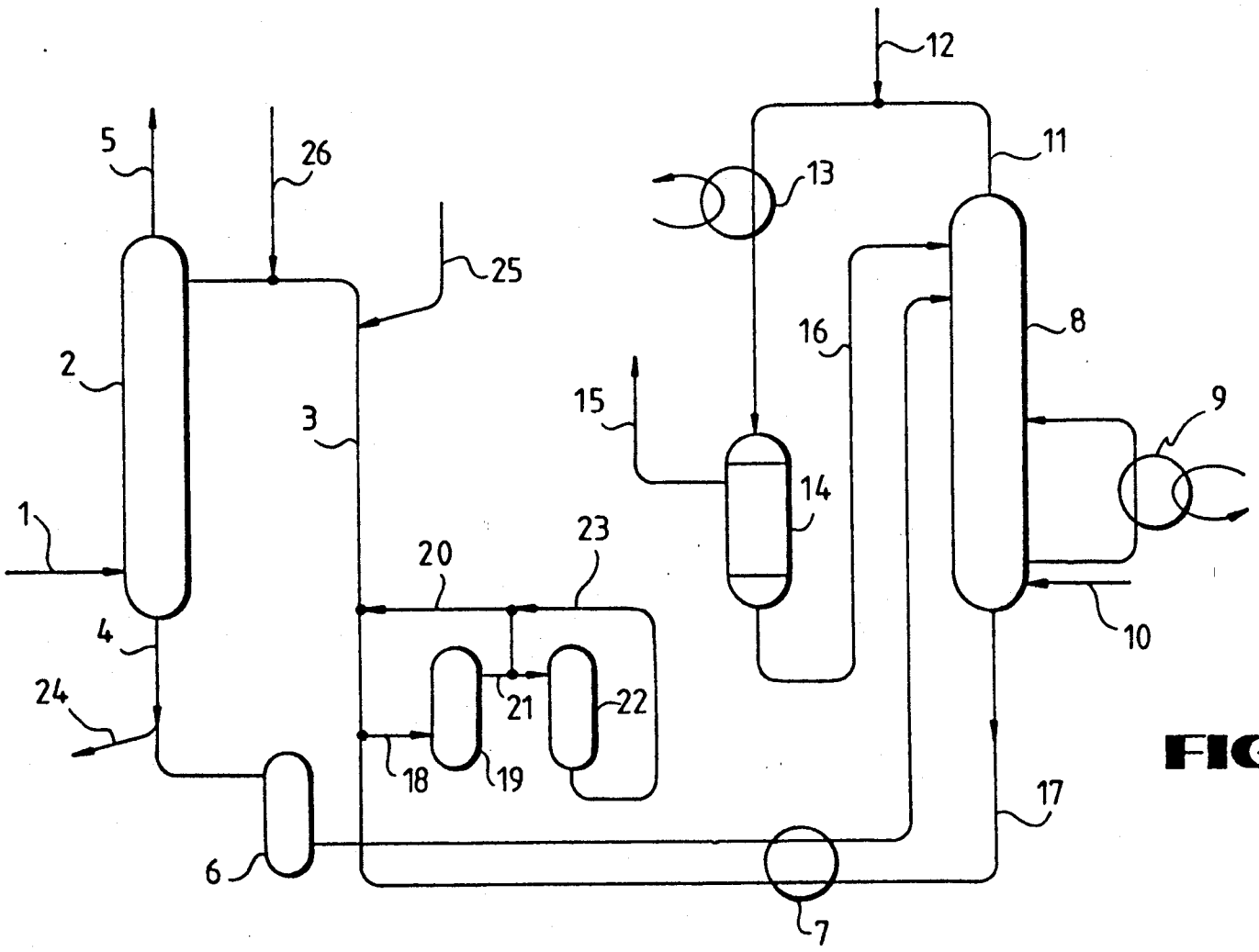

In accordance with this invention, a treating agent comprising an hydroxyl amine compound in combination with a reaction product or a mixture for the purpose of a reaction product of a polyalkylene polyamine compound and an alkynediol are added to an alkanol amine gas scrubbing system in the operation of which an alkanol amine stream is fed into a contactor to absorb acidic components of an input acid gas to give a scrubbed acid gas overhead, the alkanol amine stream rich with absorbed components is withdrawn from the contactor and passed through a regenerator to strip acidic components and give a lean alkanol amine stream, and the lean alkanol amine stream is then recycled to the contactor.

More particularly and referring to the drawing, a feed gas containing hydrogen sulfide and/or carbon dioxide is introduced through line 1 into the bottom of an absorption or contactor tower 2, having a number of gas/liquid contacting trays. The input gas or vapor containing the acid gases may be a natural gas, gas produced as a byproduct of refining or petrochemical operations, or petrochemical hydrocarbon vapors. Regenerated ("lean" or "unloaded") alkanol amine absorbent liquid, suitably in a 65% water solution, is introduced into the top of absorbent column 2 through line 3. Suitable alkanolamines include monoethanolamine, diethanolamine, diglycerolamine, methyldiethanolamine, or a mixture of one or more of them. (For mild conditions, $K_2CO_3$ solution may be substituted for the alkanolamine). "Rich" or "loaded" absorbent solution is withdrawn from contactor 2 through line 4. The treated gas, having a substantially reduced $H_2S$ content, is withdrawn overhead through line 5. The enriched absorbent solution loaded with $H_2S$ is passed through a sock filter 6 for separation of particulates and the filtered rich alkanol amine solution is next passed through a heat exchanger 7 and then introduced into the upper part of regeneration or stripper column 8, where it is stripped of $H_2S$ and $CO_2$ by means of heat supplied by reboiler 9 or live steam introduced through line 10. The $H_2S$, $CO_2$, and steam vapors resulting from stripping are withdrawn from the top .of regeneration column 8 through line 11. An agent of this invention comprising a reaction mixture of or mixture for the purpose of a reaction product of a polyalkylene polyamine compound containing from 2–10 amine groups, each separated from another by an alkylene group having from 2–6 carbon atoms, and an alkynediol containing from 2–8 carbon atoms, is introduced by line 12 into the acidic gaseous stream stripped overhead from regenerator 8. The hot vapors supplemented by the polyalkylene polyamine compound and alkynediol reaction product or mixture for the purpose of a reaction product is passed through condenser 13 and then to gas liquid separator 14. Hydrogen sulfide and $CO_2$ are withdrawn from separator 14 through line 15 while condensed water vapor and the polyalkylene polyamine/alkynediol reaction product or mixture for a reaction product is withdrawn through line 16 and recycled to the top of regeneration column 8. The regenerated or lean absorbent solution is withdrawn from regeneration column 8 by line 17 and passed through heat exchanger 7 to give up heat to the filtered loaded alkanolamine stream passing through line 4 to regeneration column 8. From heat exchanger 7, the lean amine stream passes by line 3 to the top of absorption column 2, as previously mentioned. A side slip of stream 3 is passed by line 18 to sock filter 19, and from soft filter 19 either back by line 20 to line 3, or through a shunt, by line 21 into charcoal filter 22, from which it is withdrawn by line 23 and combined with line 20. A fraction of the rich alkanolamine stream in line 4 is purged from the stream by line 24, and makeup lean absorbent solution is added by line 25. An hydroxyl amine compound of this invention is introduced into line 3 by line 26 and fed into the absorption or contactor column 2.

An effective corrosion and fouling reducing amount of the treating agent is employed. The polyalkylene polyamine component employed in the treating agent may be described by the formula $$NH_2[(CH_2)_mNH]_n(CH_2)_mNH_2$$

in which m is an integer from 1 to 6 and n is an integer from 1 to 8. Suitable polyalkylene polyamines useful in accordance with this invention are ethylenediamine, diethylenetriamine, triethylenetetramine, tetraethylenepentamine, pentaethylenehexamine, pentapropylenehexamine, and the like. Preferably, the polyalkylene polyamines of this invention contain from 2 to 6 amine groups, each separated from the other by an alkylene group having from 2 to 3 carbon atoms.

The alkynediols which are effective in producing the reaction product are those which contain from 2 to 8, and preferably from 3 to 6, carbon atoms. Examples of the alkynediols are 1,3 propynediol, 1,4 butynediol, 1,5 pentynediol, etc.

The hydroxylamine compounds useful in the treating agent in this invention are described by the formula $$R_1R_2N—OH$$

wherein $R_1$ and $R_2$ are independently hydrogen or a hydrocarbyl or both $R_1$ and $R_2$ are collectively a divalent hydrocarbyl combined with said nitrogen to form a heterocyclic ring. $R_1$ and $R_2$ independently may be alkyl or aryl groups when not collectively a divalent hydrocarbyl combined with the nitrogen to form a heterocyclic ring as with N hydroxypiperidine. Where $R_1$ and $R_2$ of the hydroxylamine are independently alkyl groups, they may have up to about 10, and preferably up to 2 to 6, carbon atoms, and include N,N-diethylhydroxylamine, N,N-dibutlhydroxylamine, and N,N-butylethylhydroxylamine. An example where $R_1$ and $R_2$ are an aryl group is dibenzylhydroxylamine. Where $R_1$ and $R_2$ are hydrogen, the hydroxylamine compounds include hydroxylamine ($NH_2OH$).

The hydroxylamine compound may be used as the free amine or as an amine salt of a mineral acid. Thus, the hydroxylamine compound hydrochlorides or sulfates are also useful as anti-foulants in this invention. The term "hydroxylamine compound" includes the free amine or the amine salt.

The polyalkylene polyamine and alkynediol composition of this invention may suitably include a chelating agent such as an alkyl metal salt of a sugar acid, suitably sodium heptogluconate, to bind magnesium and calcium ions that would interfere with water solubility of the polyamine and diol in a suitable aqueous or alcohol solvent.

Anti-foaming agents may also be added, although the hydroxylamines of this invention have good anti-foaming qualities.

The hydroxylamine compound preferably is introduced into the alkylamine stream, as described above, upstream of the point of introduction of the lean amine scrubber into the unit so that the hydroxylamine compound has maximum effect in the contactor or absorbent tower 2. The compound may be added as a concentrate or as a solution or slurry in a liquid diluent which is compatible with the alkanolamine solution. Suitable solvents include water, alcohols such as methanol, and various alkanolamines employed in the process. The concentration of hydroxylamine compound in the solvent is desirably in the range from about 10 to about 90 weight percent, and preferably from about 25 to about 75 weight percent, based on the total weight of the hydroxylamine and solvent.

The hydroxylamine is used at a concentration effective to provide the desired protection against fouling. Amounts in the range of about 0.01 to about 0.3 percent based on the weight of the alkanolamine stream are generally suitable. In practice, the appropriate amount is determined relative to the oxygen content of the feed gas. The pounds of acid gas in the fed gas determine the mol loading of the alkanolamine stream and thus the alkanolamine stream circulation rate. Acid gas content is determined by analysis of the feed gas. Oxygen content of the feed gas in parts per million (ppm) is also given by feed gas analysis. This is related to the pounds of feed gas fed per day and determines the mol loading of oxygen in the alkanolamine stream. At least a mol oxygen equal amount and preferably some excess of hydroxylamine compound is added to the system (line 26).

The ratio of polyalkylene polyamine to alkylenediol is such as to retain full reaction between the respective ingredients, with weight ratios of amine to diol suitably being in the range from 4:1 to 1:1, with about 3:1 being preferred. These components of the treating agent system are employed in corrosion inhibiting amounts in cooperation with the effect of the hydroxylamine compound. Suitably from about 100 to 5000, preferably from about 200 to 500 ppm of the polyalkylene polyamine/alkylenediol mixture in the alkanolamine solution is employed.

EXAMPLE

A mixture for the purpose of a reaction product comprising tetraethylenepentamine and 1,4-butynediol in an approximate 3:1 weight ratio was fed at an average 200–500 ppm to alkanolamine solution to the overhead line of an alkanolamine regenerator, as at line 12 of FIG. 1. An inline corrosion detector electrode located in the system, between condensor 13 and separator 14, continuously transmitted signals indicative of metal loss. This signal was captured as data in a computer. Average metal loss over a period of a year or more was 12 to 15 mils per year (mpy). Diethylhydroxylamine (DEHA) was added to supplement the tetraethylenepentamine and 1,4-butynediol and in approaching another year of run time, the average corrosion rate dropped to about 4 mpy.

Additionally, before treatment as described, the heat stable salt content ranged between 1.5 to 2%, maintained at that level by addition of sodium hydroxide.

After start of treatment, in the six months ensuing, sodium hydroxide addition necessary to maintain the 1.5–2% heat stable salt content was reduced by 67%. Time between filter cleanings increased from every 6 to 72 hours to every 10 to 12 days, as the level of circulating particulates was reduced, and the time in months to reach maximum pressure drop across the absorber tower when the system would have to be shut down to defoul the tower increased from six months to no need approaching a year of operation.

Having described this invention, variations within the scope of this invention will occur to those skilled in this art and are intended covered by the claims appended.

What is claimed is:

1. A composition for the reduction of corrosion and fouling of metal surfaces in contact with corrosive acid fluids or salts in the presence of an aqueous medium, which comprises (a) an antifouling amount of a hydroxyl amine compound, and (b) a corrosion inhibiting amount of a reaction product of a polyalkylene polyamine and an alkynediol or a mixture including a polyalkylene polyamine and an alkynediol for the purpose of a reaction product of a polyalkylene polyamine and an alkynediol only, wherein said reaction product results from reacting the polyalkylene polyamine with the alkynediol at a weight ratio of from about 1–4 parts by weight of the polyalkylene polyamine to 1 part by weight of the alkynediol under conditions effective to react substantially all the alkynediol.

2. The composition of claim 1 in which said hydroxylamine compound has the formula $$R_1R_2N—OH$$

wherein $R_1$ and $R_2$ are independently hydrogen or a hydrocarbyl or both $R_1$ and $R_2$ are collectively a divalent hydrocarbyl combined with said nitrogen to form a heterocyclic ring.

3. The composition of claim 2 in which said polyalkylene polyamine contains from 2 to 10 amine groups, each separated from another by an alkylene group having from 2 to 6 carbon atoms.

4. The composition of claim 3 in which said alkynediol contains from 2 to 8 carbon atoms.

5. The composition of claim 1 wherein said hydroxylamine compound is diethylhydroxylamine, said polyalkylene polyamine is tetraethylenepentamine, and said alkynediol is 1,4-butynediol.

* * * * *